US008459487B2

(12) United States Patent
Sharma et al.

(10) Patent No.: US 8,459,487 B2
(45) Date of Patent: Jun. 11, 2013

(54) ADJUSTABLE STRAP-LOCK FOR SECURING CONTAINER LIDS TO THE BASE CONTAINER IN CLOSED POSITION

(76) Inventors: Rajneesh Sharma, Toronto (CA); Alicia Lai Yin Sharma, Toronto (CA)

( * ) Notice: Subject to any disclaimer, the term of this patent is extended or adjusted under 35 U.S.C. 154(b) by 694 days.

(21) Appl. No.: 12/369,515

(22) Filed: Feb. 11, 2009

(65) Prior Publication Data

US 2010/0200604 A1 Aug. 12, 2010

(51) Int. Cl.
*B65D 45/00* (2006.01)

(52) U.S. Cl.
USPC ..... 220/315; 220/318; 220/908; 220/324; 248/499

(58) Field of Classification Search
USPC .... 220/754, 729, 324, 908, 318, 315; 410/97, 410/100; 248/499, 505, 907; 224/578, 579; 294/150
See application file for complete search history.

(56) References Cited

U.S. PATENT DOCUMENTS

| | | | | | |
|---|---|---|---|---|---|
| 2,687,318 | A * | 8/1954 | Cooper | 292/114 |
| 2,974,990 | A * | 3/1961 | Mereness | 292/288 |
| 2,984,511 | A * | 5/1961 | Hedrick | 292/258 |
| 2,998,276 | A * | 8/1961 | Shettler | 292/288 |
| 3,124,381 | A * | 3/1964 | Geldart | 292/258 |
| 3,291,515 | A * | 12/1966 | Lierman | 292/288 |
| 3,363,924 | A * | 1/1968 | Remig | 292/258 |
| 3,589,760 | A * | 6/1971 | Williams | 292/258 |
| 3,674,298 | A * | 7/1972 | Vekony | 292/258 |
| 3,893,725 | A * | 7/1975 | Coulter et al. | 292/258 |
| 3,980,202 | A * | 9/1976 | Monyak et al. | 220/318 |
| 4,009,897 | A * | 3/1977 | Spellman | 292/258 |
| 4,241,846 | A * | 12/1980 | Murphy | 220/318 |
| 4,413,851 | A * | 11/1983 | Ritter | 292/259 R |
| 4,478,348 | A * | 10/1984 | Cook | 220/318 |
| 4,545,501 | A * | 10/1985 | DeFord | 220/318 |
| 4,976,371 | A * | 12/1990 | Wise et al. | 220/315 |
| 5,063,641 | A * | 11/1991 | Chuan | 24/197 |
| 5,078,295 | A * | 1/1992 | Grant | 220/318 |
| 5,297,692 | A * | 3/1994 | Kronmiller | 220/318 |
| 5,620,215 | A * | 4/1997 | Janeway | 292/256 |
| 5,758,914 | A * | 6/1998 | Ioveno | 292/288 |
| 6,032,916 | A * | 3/2000 | Holliday | 248/505 |
| 6,041,960 | A * | 3/2000 | Leal | 220/315 |
| 6,230,920 | B1 * | 5/2001 | Porter | 220/319 |
| 6,318,612 | B1 * | 11/2001 | MacNeil | 224/572 |
| 6,390,522 | B1 * | 5/2002 | Rucker | 294/15 |
| 6,418,594 | B1 * | 7/2002 | Miller | 24/298 |
| 6,675,977 | B2 * | 1/2004 | Parks | 211/41.9 |

(Continued)

*Primary Examiner* — Anthony Stashick
*Assistant Examiner* — Christopher McKinley
(74) *Attorney, Agent, or Firm* — Stuart L Wilkinson

(57) ABSTRACT

A securing assembly for fastening a container lid to an open topped container, the container having a pair of container fixture elements at opposed positions at the top of the container. The securing assembly is a strap having a pair of strap spans. One strap span extends between one of a pair of lid fixture elements and one buckle member. The other strap span extends between the other lid fixture element and another buckle member, the buckle members engageable to buckle the strap spans together. The container fixture elements engage with respective lid fixture elements for fixing the buckled strap spans so that the lid is held against the container top. A loop is attached to and extends from one anchor location on the first strap span to another anchor location on the second strap span, the loop position at the one anchor location being adjustable, so as to alter the length of the loop and to correspondingly alter the length of the first strap span.

9 Claims, 5 Drawing Sheets

U.S. PATENT DOCUMENTS

| | | | | |
|---|---|---|---|---|
| 6,705,811 | B1 * | 3/2004 | Selby | 410/3 |
| 6,755,383 | B2 * | 6/2004 | Davis | 248/508 |
| 6,772,485 | B2 * | 8/2004 | Alpert | 24/300 |
| 6,808,227 | B1 * | 10/2004 | Ayler | 296/167 |
| 6,880,717 | B1 * | 4/2005 | O'Conor | 220/318 |
| 6,902,081 | B2 * | 6/2005 | Walker | 220/315 |
| 7,103,944 | B2 * | 9/2006 | Johnson | 24/300 |
| 7,325,281 | B1 * | 2/2008 | Willems et al. | 24/302 |
| 7,343,648 | B2 * | 3/2008 | Shaw | 24/68 CD |
| 2001/0045548 | A1 * | 11/2001 | Landy | 254/217 |
| 2004/0065666 | A1 * | 4/2004 | Walker | 220/315 |
| 2005/0019126 | A1 * | 1/2005 | Pingel | 410/30 |
| 2006/0138188 | A1 * | 6/2006 | Kramer | 224/581 |
| 2008/0127461 | A1 * | 6/2008 | Linden et al. | 24/302 |
| 2008/0169289 | A1 * | 7/2008 | Dawn | 220/315 |

* cited by examiner

ADJUSTABLE STRAP-LOCK FOR SECURING CONTAINER LIDS TO THE BASE CONTAINER IN CLOSED POSITION

PRIOR INVENTIONS

Referenced patents;

U.S. Pat. No. 4,976,371 to Wise et al. dated Aug. 15, 1989
U.S. Pat. No. 4,545,501 to DeFord dated Nov. 1, 1984
U.S. Pat. No. 4,413,851 to Ritter dated May 26, 1981
U.S. Pat. No. 4,150,464 to Tracy dated Aug. 10, 1977
U.S. Pat. No. 4,009,897 to Spellman dated Apr. 23, 1976
U.S. Pat. No. 3,980,202 to Monyak et al. dated Dec. 2, 1975
U.S. Pat. No. 5,385,258 to Sutherlin dated Oct. 4, 1993
U.S. Pat. No. 5,438,737 to Anscher et al dated Apr. 14, 1994
U.S. Pat. No. 5,758,914 to Loveno dated Jan. 8, 1997
U.S. Pat. No. 5,991,985 to Galbreath dated Jul. 31, 1998
U.S. Pat. No. 6,902,081 to Walker dated Oct. 1, 2003

A number of lid locking mechanisms are already known but none of them work very well. They are either difficult to use, have applicability only for certain kind of garbage bins, require special tools and installation such as drilling holes in the garbage bin or are hazardous to the user and city garbage collectors.

For example, "bungee" cords can be used for the same purpose but they are difficult to put on and can hurt the fingers of person who is putting it on and can hurt the garbage removal personnel. Moreover, the length of the bungee cords is not adjustable so a user needs to buy different bungee cords for different container sizes. The elastic of the bungee cords also loosens over time.

In Walker's U.S. Pat. No. 6,902,081 invention, the user needs to drill four holes in the garbage container, which could be difficult for women or people who do not have those tools to install. It also leaves permanent holes in the garbage bin and if a user is not happy with the product for any reason, the user is still left with a garbage bin with undesired holes in it. The fact that it is permanently attached to the garbage bins may not be a desirable feature for some people.

DESCRIPTION

Scope of the Invention

A one-piece apparatus for securing the lid to the base of containers such as garbage bins when the said container has two handles on its side walls. The purpose of the invention is to prevent opening or separating the lid altogether from the base container by wind, or by domestic or wild animals such as dogs, raccoons, bears etc. until the strap-lock is manually disengaged. This invention is targeted to the new kitchen and regular garbage bins under the "Green Bin Program" that are now mandated by several municipalities in Ontario and are getting implemented in several other major cities across Canada and other countries. However, the invention is also targeted to other garbage bins or regular containers where the base container has a minimum of two side handles, one on each diametrically opposite side of a round can or on two opposite sides of a rectangular/trapezoid shaped can that can be latched on by a hook. This strap lock assembly can also be used for indoor containers to keep them closed in order to lock the odour or just for packaging. The adjustable length feature allows the apparatus to fit on most of the household containers/garbage bins available in the marketplace.

BACKGROUND OF THE INVENTION

It is a well known problem that domestic and wild animals such as dogs, raccoons, bears mouse etc. try to get in the garbage or food container in search of food. The problem is especially acute because people like to put the garbage containers outside the house for health/sanitary reasons and to prevent odour from getting in the living space. These garbage bins are quiet often attacked by animals such as raccoons, bears in search of food and they sometimes end up toppling the garbage container and spreading kitchen refuse everywhere. Most of the prior inventions rely on elastic material such as a bungee cord that can hurt the user and the garbage collectors, requires a lot of hardware and tools for installation such as drills and drill bits that may not be user friendly for women and children or simply don't work effectively.

SUMMARY OF THE INVENTION

The adjustable Strap-Lock assembly comprises of one strap made of non-stretch flexible material such as polypropylene with length longer than the diameter of the container, a strap tightening buckle such as side release buckle, two hooks and a strap loop. The strap is looped through one end of the side buckle and then stitched to itself to fix the position of the side release buckle along the strap length. The strap is then looped through the other end of the side release buckle and one hook is stitched to each end of the strap.

One can easily latch hooks on each handle of the base container, snap lock the side release buckle and then pull the strap through the second end of the side release buckle until the strap tightens the lid to the base container. There is also a loop provided along the length of the strap so that the extra strap after tightening the lid can be easily tucked in. The strap loop comes with an extension with a reinforced hole in the center through which the Strap-Lock can be permanently to container lid, if so desired. One can easily disengage the Strap-lock by squeezing the side release buckle from both sides causing it to open. The Strap-Lock will then become lose and can be easily taken off.

The present invention is better in all respects than existing inventions that can be used for the same purpose because:

- It does not require any installation to be effective. However, it does provide a user the ability to install it on the container lid, if so desired
- Since no tools are necessary for the Strap-Lock, women and children will find it easier to use
- It uses simple one piece construction that is easy to use and store
- The locking and unlocking mechanism is also very easy with a side release buckle
- It is adjustable in length so the same Strap-Lock can be used for many different container sizes as long as the diameter of the container is less than the total strap length
- It provides a strap loop to tuck in the extra strap to make the assembly aesthetically pleasing
- The loop construction through the side release buckle allows easy storage on the container handle or any other bar/hook when the assembly is not in use

DETAILED DESCRIPTION OF THE DRAWINGS

Figure 1:
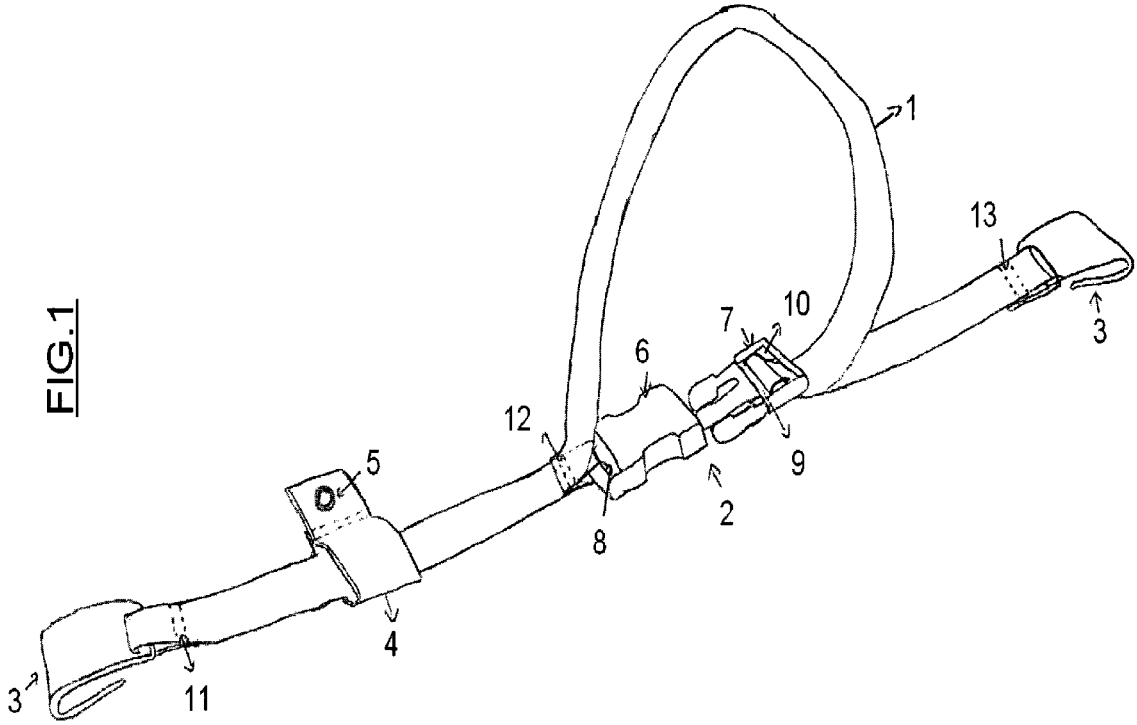
FIG. 1 is a three dimensional view of present invention, an Adjustable "Strap-Lock" Assembly

FIG. 1 is a three dimensional view of present invention. It consists of a non-stretch strap 1, a side release buckle 2, two hooks 3, and a strap loop 4 with a metal ring 5. The strap 1 is folded through the grooves of hooks 3 and stitched at 11 and 13. The strap is looped from bottom to top through the groove 9 and then from top to bottom through the groove 10 of the male end 7 of the side release buckle 2. The strap 1 then goes over the top of the side release buckle 2 and then looped from top to bottom through groove 8 of female end 6 of the side release buckle 2 and then stitched to itself so that there is a constant length of strap 1 between the female end 6 of the side release buckle to the hook 3. After stitching to itself at 12 the strap 1 is then pulled through the strap loop 4 which has an extended strap where a hole 5 is provided with metal ring enforcement and then the end of the strap 1 is looped from top to bottom of groove in hook 3 and then stitched to itself.

Figure 2:
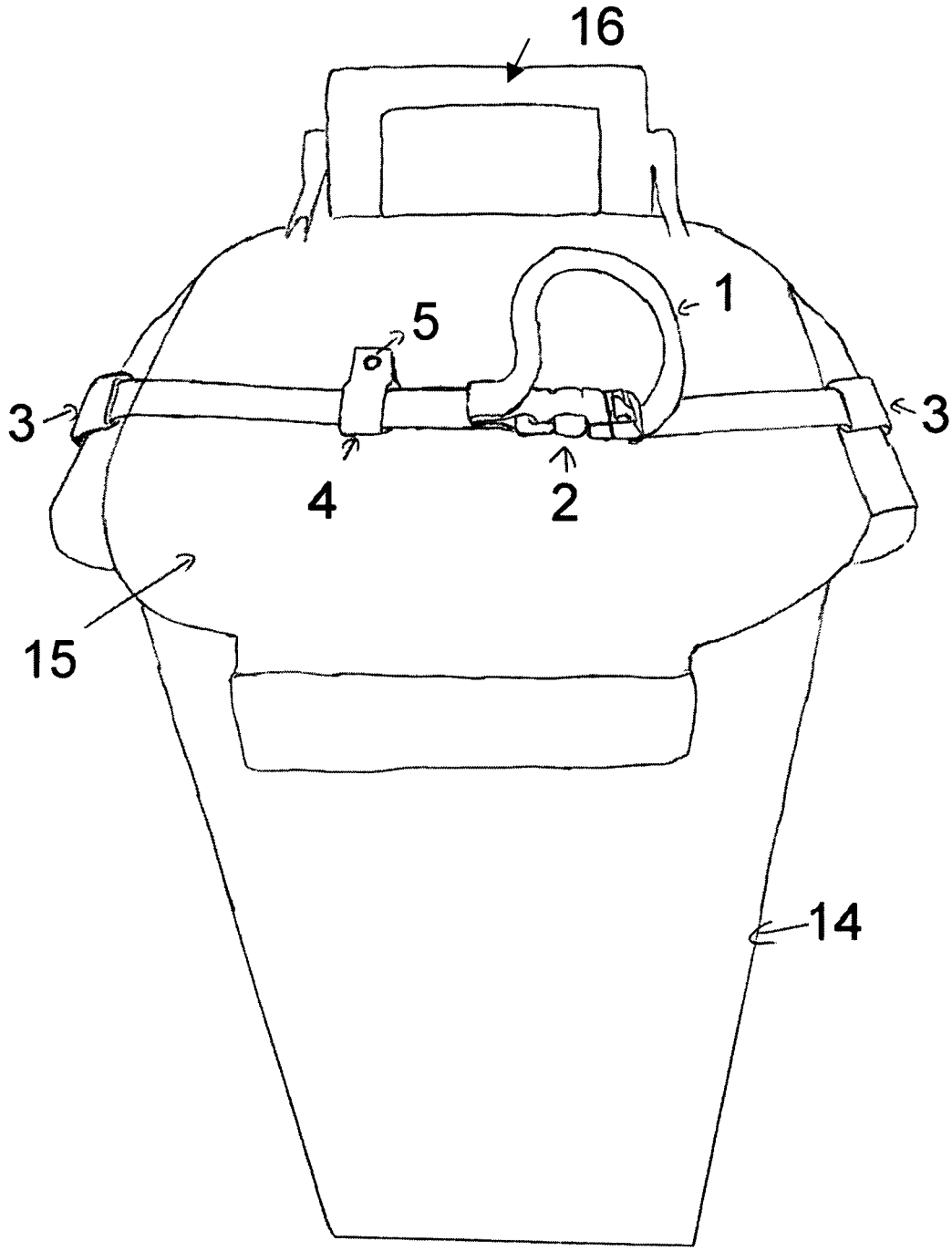
FIG. 2 is a three dimensional view of Strap-Lock in use on a garbage bin but the extra strap after tightening is not tucked in the strap loop.
Figure 3:
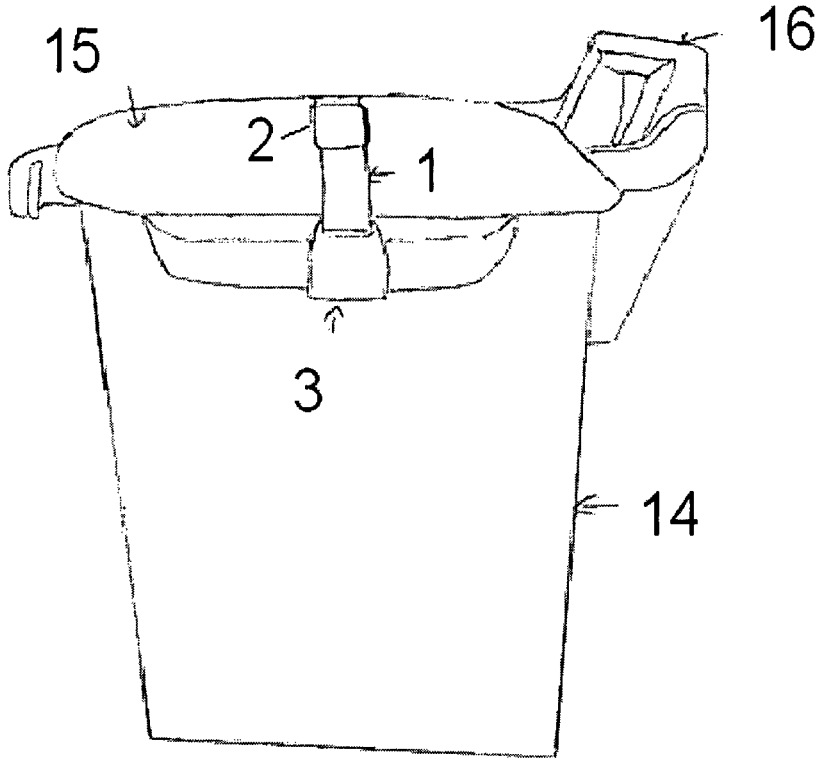
FIG. 3 is a side view of garbage bin and Strap-Lock in FIG. 2 and the extra strap length is shown tucked in the strap loop.
Figure 4:
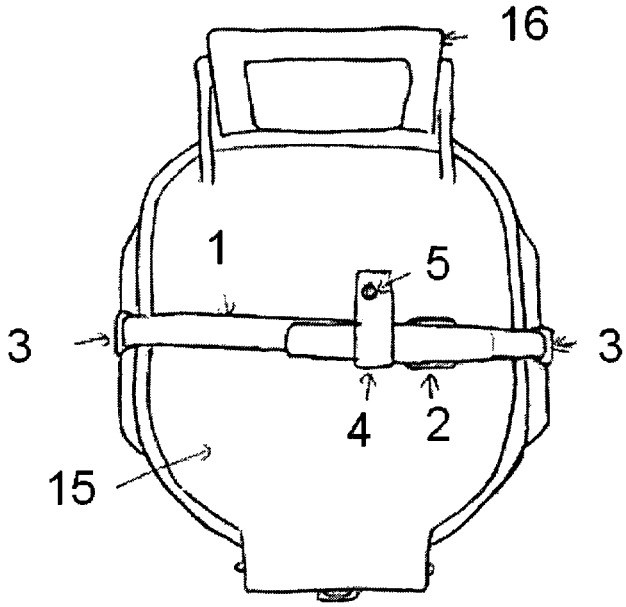
FIG. 4 is top view of the garbage bin and Strap-Lock in FIG. 2 and the extra strap length is shown tucked in the strap loop.
Figure 5:
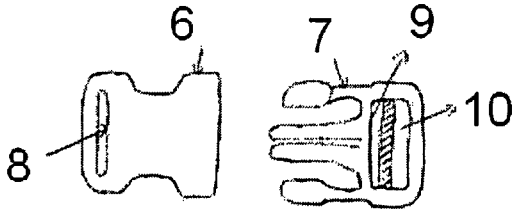
FIG. 5 is a schematic view of the side release buckle.
Figure 6:
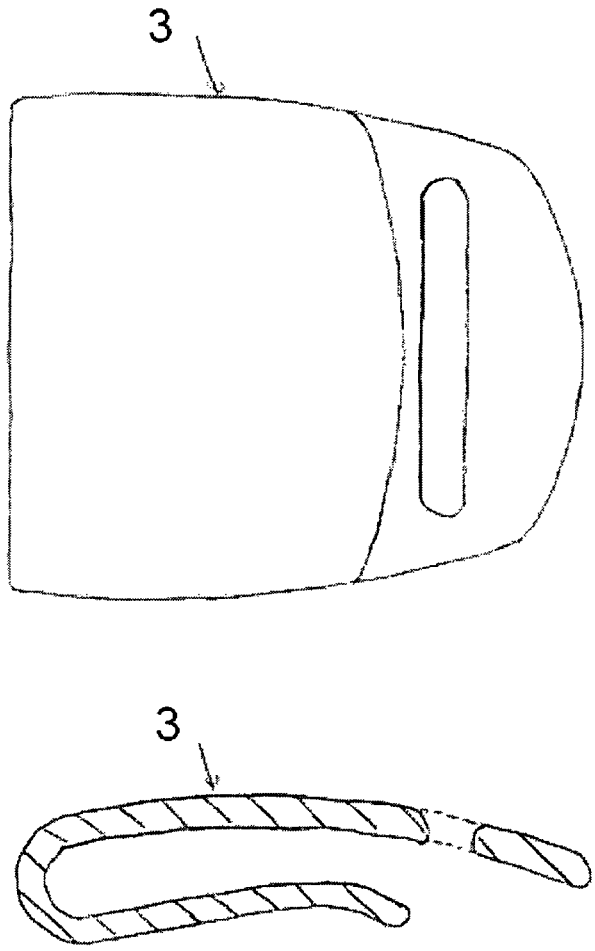
FIG. 6 is a schematic view of custom designed curved hook to hit the handles of the Green Bin

FIGS. 2, 3 and 4 shows the application of the adjustable strap-lock assembly as shown in FIG. 1 on a garbage container 14. The garbage container 14 is of rectangular shape with a lid 15 at the top of the garbage bin. The lid is hinged to the base of the garbage container 14. Curved hooks 3 are custom made to fit on the curved handles of this garbage container and shown in FIG. 6. One can easily put the curved hooks 3 on to the handles of garbage container 14 and then snap lock the side release buckle 2 by pushing the male end 7 telescopically in the female end 6. The strap 1 is the pulled upwards from groove 10 of the male end 7 of the side release buckle 2 until it can not be pulled anymore. This will tighten the strap 1 along the length of the lid 15 such that the lid is now tightly secured to the base container 14. One can place the length of the strap 1 that was pulled through the groove 10 in the strap loop 4. When someone wants to unlock the Strap-Lock, they can easily squeeze the legs of the male end 7 of the side release buckle 2 which will separate the male 7 and female end 6 of the side release buckle 2. The strap 1 will loosen and then can be easily taken off the garbage bin and stored somewhere. As it is evident now, one does not need to drill a hole on the garbage bin for the strap-lock to function.

If one wants to permanently attach the Strap-Lock on to the garbage bin 14, they can do so either using a nut-and-bolt fastener through the hole 5 on the strap loop or they can run a strong string through the hole 5 and tie it to the handle 16 of the garbage bin.

It should be noted that the present invention is not limited to the use of a side release buckle as a mechanism to tighten the strap 1. The same result can be achieved by using some other types of buckles such as cam buckle, ratchet buckle or a dual adjusting side release buckle but it is our opinion that a regular side release buckle is the easiest one to use.

It should also be noted that this invention is not limited to the use of curved hooks. Obviously, as different garbage containers come with different shapes of handles, the hooks can be made of such a shape as to effectively latch on to the garbage bin handles. Most versatile hooks will be curved hooks, flat hooks and S shaped hooks.

The straps preferably comprise a flexible non-stretch elongate material. Preferred such materials includes woven webbing of synthetic materials such as Nylon, polypropylene and the like and is commercially available in various widths.

The invention has been described with reference to preferred embodiments. While various changes may be made in detailed construction, it is understood that such changes would be in the spirit of the present invention as it is defined in the appended claims.

We claim:

1. A non-stretch, flexible securing strap for fastening a container lid to an open topped container having a pair of container fixture elements at opposed positions at the top of the container, the securing strap comprising a first strap span having a first part extending from one of a pair of strap fixture elements to a first strap adjustment means being a sole means of altering the length of the first part, the first strap adjustment means combined with a first buckle member, a second strap span having a second part extending from the other of the pair of strap fixture elements to a second strap adjustment means being a sole means of adjusting the length of the second part, the second strap adjustment means combined with a second buckle member, an extension loop extending between the first strap adjustment means and the second strap adjustment means, the first and second buckle members releasably engageable to buckle the first strap span to the second strap span, the strap fixture elements for engagement with respective ones of the container fixture elements for fixing the buckled strap to the container with the lid held thereby against the container top, the first strap length adjustment means permitting adjustment to alter the length of the extension loop and to correspondingly alter the length of the first part.

2. A securing strap as claimed in claim 1, the strap fixture elements comprising hooks and the container fixture elements comprising bars.

3. A securing strap as claimed in claim 1, the container fixture elements comprising protruding side handles on the container, the strap fixture elements having a detent part for engaging under respective ones of the protruding side handles.

4. An arrangement comprising the securing strap of claim 1, the securing strap applied to the container lid combination by engagement of the container fixture elements with the strap fixture elements.

5. An arrangement as claimed in claim 4, the arrangement configurable between a released condition to permit opening of the lid and an applied condition to secure the lid in a closed position.

6. An arrangement as claimed in claim 4, the container and lid being generally round, the container fixture elements being handles located at diametrically opposed positions.

7. An arrangement as claimed in claim 4, the container and lid being generally polygonal, the container fixture elements being handles located on generally opposed sides of the container.

8. An arrangement as claimed in claim 4, the lid being fully detachable from the container.

9. An arrangement as claimed in claim 4, the lid being attached to the container by a hinge.

* * * * *